United States Patent [19]

Tamura et al.

[11] 4,430,411

[45] Feb. 7, 1984

[54] DEVELOPING METHOD FOR ELECTROSTATIC IMAGE

[75] Inventors: Yasuyuki Tamura, Kawasaki; Masashi Kiuchi, Toride; Tohru Takahashi, Tokyo; Yasuo Mitsuhashi, Yokohama; Seiji Tomari, Toride, all of Japan

[73] Assignee: Canon Kabushiki Kaisha, Tokyo, Japan

[21] Appl. No.: 241,973

[22] Filed: Mar. 9, 1981

Related U.S. Application Data

[63] Continuation of Ser. No. 27,722, Apr. 6, 1979, abandoned.

[30] Foreign Application Priority Data

Apr. 11, 1978 [JP] Japan ..... 53-42487
Apr. 21, 1978 [JP] Japan ..... 53-47512

[51] Int. Cl.[3] ..... G03G 13/09
[52] U.S. Cl. ..... 430/122; 118/657
[58] Field of Search ..... 430/122, 111; 118/657, 118/658; 355/3 DD

[56] References Cited

U.S. PATENT DOCUMENTS

| | | | |
|---|---|---|---|
| 3,098,765 | 7/1963 | Keller et al. | 118/657 X |
| 3,152,924 | 10/1964 | Wanielista et al. | 118/657 X |
| 3,640,247 | 2/1972 | Mason et al. | 118/657 |
| 3,828,730 | 8/1974 | Yamashita et al. | 118/658 |
| 4,121,931 | 10/1978 | Nelson | 118/657 X |
| 4,128,328 | 12/1978 | Matsui | 118/657 X |

*Primary Examiner*—John P. McIntosh

[57] ABSTRACT

A developing device in which a one-component magnetic developer is brought into contact with an electrostatic image carrier in a developing station while it is conveyed in a predetermined direction, to thereby develop a desired electrostatic image is provided with developer carrier means carrying the one-component magnetic developer on the peripheral surface thereof and bringing the developer into contact with the electrostatic image carrier, means for moving a magnetic field along the peripheral surface of the developer carrier means to thereby move the one-component magnetic developer in the direction opposite to the direction of movement of the magnetic field, and means for moving the developer carrier means in the direction of movement of the magnetic field.

18 Claims, 5 Drawing Figures

DEVELOPING METHOD FOR ELECTROSTATIC IMAGE

This is a continuation of application Ser. No. 027,722, filed Apr. 6, 1979, now abandoned.

BACKGROUND OF THE INVENTION

1. Field of the Invention

This invention relates to a device for developing an electrostatic image by the use of a one-component magnetic developer.

2. Description of the Prior Art

The cascade developing method and the magnet brush developing method have heretofore been widely used to develop electrostatic images formed by various known electrophotographic methods or electrostatic recording methods. These two developing methods have a common feature in that they use a two-component developer consisting of a suitable ratio of a mixture of minute coloring particles called toner and relatively rough particles called carrier and that the toner frictionally charged by the frictional contact thereof with the carrier is selectively deposited on the electrostatic image. However, these two developing methods have serious problems coming from the above-noted common feature.

A first problem is one regarding the supply of the developer. In the above-mentioned two-component developer, it is necessary in order to prevent fog during development and to provide a proper image density that the ratio of mixture of the toner and the carrier is always at a certain constant value. On the other hand, it is the toner only that is consumed by being deposited on an electrostatic image carrier during the development. Therefore, a complicated toner supply device is necessary to maintain the constant ratio of mixture at all times, but no fully satisfactory toner supply device has been put into practice.

A second problem is concerned with the deterioration of the developer. If the developer is used for a long time, the coating of the resin component of the toner is formed on the surface of the carrier particles and the frictional charging characteristic between the toner and the carrier becomes deteriorated. Therefore, the developer itself must cumbersomely be replaced by fresh one.

The above-noted problems may be avoided by using a one-component developer which does not contain the above-mentioned carrier by which the toner is frictionally charged.

Various devices for developing electrostatic images by the use of a one-component developer are also known and it is usual with the devices of this type to use a magnetic developer as the one-component developer, which mangetic developer comprises coloring particles (toner particles) containing fine particles of a magnetic material such as magnetite or the like. To take out such one-component magnetic developer from its supply station and convey it through a developing station, use has often been made of a mechanism having a non-magnetic cylindrical member opposed to the electrostatic image carrier in the developing station with a minute clearance interposed therebetween, and a multi-pole magnet member disposed within the hollow of the cylindrical member. The non-magnetic cylindrical member takes the supply of the one-component magnetic developer on the peripheral surface thereof and carries the developer layer on the peripheral surface; to convey the magnetic developer layer carried on the peripheral surface of the non-magnetic cylindrical member from its supply position through the developing station to its containing position, the conventional devices have adopted one of various methods, namely, a method whereby the multi-pole magnet member is unrotatably fixed while the non-magnetic cylindrical member is rotatively driven in the direction of conveyance of the developer, or a method whereby the non-magnetic cylindrical member is unrotatably fixed while the multi-pole magnet member is rotatively driven in the direction opposite to the direction of conveyance of the developer, or a method whereby the non-magnetic cylindrical member is rotatively driven in the direction of conveyance of the developer while the multi-pole magnet member is rotatively driven in the direction opposite to the direction of conveyance of the developer.

On the other hand, in the developing devices using the one-component magnetic developer, the clearance between the cylindrical member and the electrostatic image carrier in the developing station is usually narrow. However, in the conventional developer conveyance method, the conveyed developer is liable to be pressed in the narrow interval between the cylindrical member and the electrostatic image carrier. When such pressing phenomenon occurs, the developer is liable to adhere to the peripheral surfaces of the cylinder and the electrostatic image carrier to damage the electrostatic image carrier and this not only results in degraded quality of the developed image and hampered reproducibility of the image but also results in reduced or no disturbance movement of toner particles in the developer pressing portion even if no adherence of the developer takes place, and this in turn results in an inconvenience that the electrostatic image is not developed at all or details thereof are not developed to reduce the development density of the wider area image portion. Such inconvenience also occurs to a device in which the electrostatic image carrier is moved in the direction opposite to the direction of conveyance of the developer in the developing station, and is particularly pronounced for the devices in which the electrostatic image carrier is moved in the same direction as the direction of conveyance of the developer, or for weakly magnetic developer, or under high-temperature and high-humidity conditions.

Further, in order to obtain a developed image having a higher density and having more faithfully reproduced image details, it is desirable to lengthen the developing time by forming a pool of developer (an accumulation of developer forming a contact region upstream by an amount corresponding to the length of a downstream contact region, in the region in which the developer contacts the electrostatic image carrier upstream of the minimum clearance portion in the developing station between the electrostatic image carrier and the developer carrier means such as non-magnetic cylinder with respect to the path of conveyance of the developer) on the inlet side (with respect to the path of conveyance of the developer) of the interval portion between the non-magnetic cylinder and the electrostatic image carrier, namely, the developing station and widening the developing width (the length of contact of the developer with the electrostatic image carrier with respect to the direction of movement of the electrostatic image carrier). However, where such a pool of developer is formed, the above-mentioned pressing phenomenon is more liable to occur in the conventional developer conveying method and if not so, the degree of disturbance movement of the toner particles in such pool portion becomes low and the widened developing width does not result in a correspondingly increased developing effect.

SUMMARY OF THE INVENTION

It is a primary object of the present invention to provide a developing device using a one-component magnetic developer which can eliminate all of the above-noted inconveniences.

It is another object of the present invention to provide a simply constructed developing device using a one-component magnetic developer which can eliminate all of the above-noted inconveniences.

It is still another object of the present invention to provide a developing device using a one-component magnetic developer which may prevent the phenomenon of the developer being pressed in the developing station to thereby provide good developed images.

It is yet still another object of the present invention to provide a developing device using a one-component magnetic developer which can easily form a pool of developer in the inlet region of the developing station.

It is a further object of the present invention to provide a developing device using a one-component magnetic developer which effectively utilizes the pool of developer to provide good developed images.

Other objects and features of the present invention will become apparent from the following detailed description taken in conjunction with the accompanying drawings.

DESCRIPTION OF THE PREFERRED EMBODIMENTS

Figure 1:
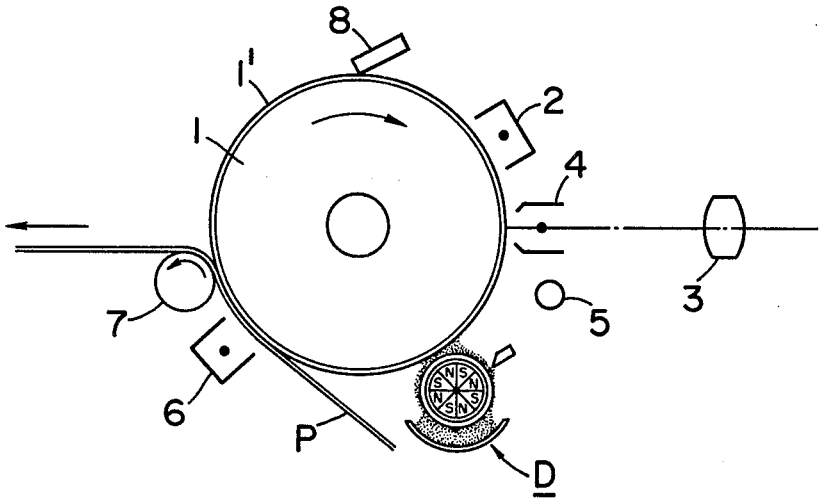
FIG. 1 illustrates an electrophotographic copying machine which may utilize the developing device of the present invention.

FIG. 1 is a schematic view of an example of the image transfer dry development type electrophotographic copying apparatus to which is applicable the developing device using one-component magnetic developer according to the present invention. Designated by 1 is a drum having on the peripheral surface thereof an electrophotographic sensitive medium 1' comprising, for example, an electrically conductive substrate, a photoconductive layer and a transparent insulating layer successively layered in the named order. The drum 1 is rotatively driven at a constant velocity in the direction of arrow. With the rotation thereof, the photosensitive medium 1' has the surface thereof uniformly charged by a D.C. corona discharger 2 and to the positive polarity if the photoconductive layer is an N-type semiconductor or to the negative polarity if the photoconductive layer is a P-type semiconductor. The photosensitive medium 1' is exposed to the image of an original to be copied, through a slit via a lens 3 and simultaneously therewith, the photosensitive medium is subjected to A.C. corona discharge or D.C. corona discharge opposite in polarity to the discharge of the discharger 2, by a corona discharger 4. Thus, a charge pattern corresponding to the image of the original is formed on the photosensitive medium 1' and further, by the entire surface of the photosensitive medium being uniformly exposed to the light from a lamp 5, there is formed on the photosensitive medium an electrostatic image of a high contrast corresponding to the image of the original. This electrostatic image is developed with the aid of one-component magnetic developer by a dry type developing device D according to the present invention which will further be described. The developed image formed on the photosensitive medium 1', namely, the toner image, is transferred to transfer paper P such as plain paper or the like which is brought into contact with the surface of the photosensitive medium 1'. The transfer paper P is subjected to D.C. corona discharge from a corona discharger 6 on the back side thereof at the position of contact thereof with the photosensitive medium, namely, that side of the transfer paper opposite to the side thereof to which to toner image is transferred. The discharge polarity of the discharger 6 is opposite to the charge polarity of the toner forming the developed image. Due to the image transfer electric field formed by such back side charging of the transfer paper P, the toner on the photosensitive medium 1' is transferred therefrom to the surface of the transfer paper P. In the field of electrophotography or electrostatic recording of such type, this image transfer electric field is usually of the order of $10^4$ V/cm. The paper P to which the toner image has thus been transferred is separated from the photosensitive medium 1' by separator means 7 and conveyed to a fixing device, not shown, for fixation of the toner image.

On the other hand, after the image transfer step, the photosensitive medium 1' is cleaned by cleaning means 8 such as a rubber blade urged against the surface of the photosensitive medium to remove any residual toner thereon and is again used for another cycle of image process.

The so-called Carlson process may also be adopted as the image transfer type electrophotographic process and in such case, the means 4 and 5 in FIG. 1 may be eliminated.

Figure 2:
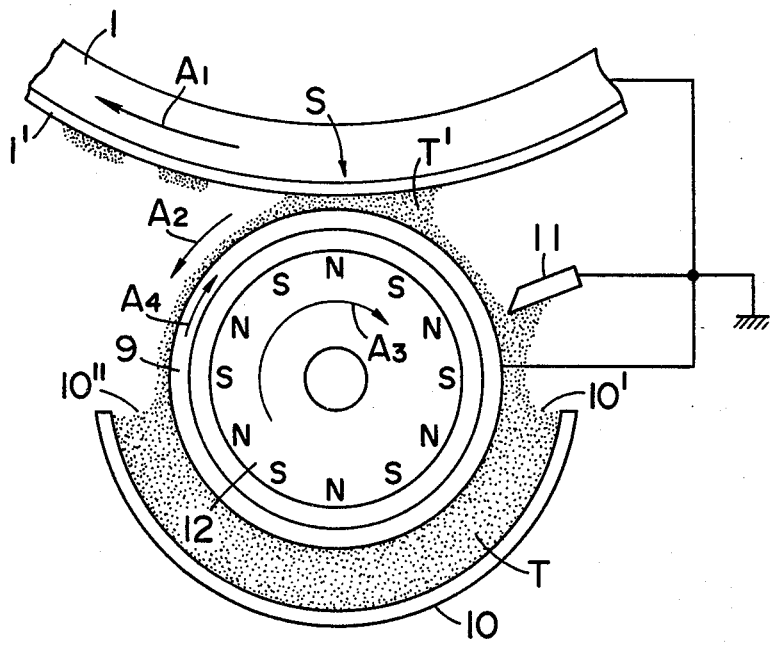
FIG. 2 illustrates an embodiment of the present invention.

FIG. 2 illustrates an embodiment of the developing device D shown in FIG. 1. The one-component magnetic developer used for the electrophotography or electrostatic recording having the image transfer step should desirably be highly insulative in order to provide a high image transfer efficiency in the electrostatic image transfer process. As the result of the experiment, it has been confirmed that it is preferable for such developer to have a volume resistivity of $10^{14}$ Ωcm or higher in an electric field of $10^4$ V/cm (the image transfer electric field usually formed in the electrostatic image transfer process) in an undisturbed, static state and that in such case, a transfer image of practically usble densiy can be provided. (In the electrophotography of the type which uses photosensitive paper with adopting the image transfer step, the one-component magnetic developer used may of course be insulative or electrically conductive.)

Designated by 1' is the above-described electrophotograhic sensitive medium and in FIG. 2, the drum-like conductive back-up member 1 serving also as the electrically conductive layer is electrically grounded as shown. In FIG. 2, the photosensitive medium 1' is rotated in the direction of arrow $A_1$.

Denoted by 9 is a circular cylinder formed of a non-magnetic, electrically conductive material such as aluminum or non-magnetic stainless steel. The cylinder 9 is so disposed that the peripheral surface thereof in the developing station S has a minute clearance with respect to the peripheral surface of the photosensitive medium 1', and the peripheral surface of the cylinder carries thereon a one-component magnetic developer layer in order to convey developer and to bring the developer layer into contact with the photosensitive medium 1' in the developing station S. In the embodiment shown in FIG. 2, the cylinder 9 is electrically conductive up to the peripheral surface thereof carrying the developer and is electrically grounded in FIG. 2.

Designated by 10 is a developer container which contains insulative, one-component magnetic developer T and brings such developer into contact with the peripheral surface of the cylinder 9. The developer T is brought from the outlet 10' of the container 10 to the developer station S (the area in which the developer is brought into contact with the photosensitive medium), and the amount of the developer which is not consumed in the developing station S is returned to the inlet 10'' of the container 10. If the surface of the container 10 which contacts the developer is electrically conductive, it is preferable in more stabilizing the potential condition of the developer and forming a good developed image to ground the container 10 to render it to the same potential as the cylinder 9 so as to avoid formation of an electric field between the two. Of course, the container 10 may also be formed of an insulating material.

Denoted by 11 is a developed doctor blade which is disposed downstream of the developer supply station but upstream of the developing station S and with a predetermined clearance with respect to the peripheral surface of the cylinder 9. This blade 11 interrupts excess portion of the developer brought out from the container 10 and removes the same so as to ensure a proper amount (and accordingly a proper thickness) of developer layer to be conveyed to the developing station. In the illustrated embodiment, the interval between the blade 11 and the cylinder 9 is greater than the minimum interval between the cylinder 9 and the photosensitive medium 1' at the developing station S, so that a pool T' of the developer is formed at the inlet side area of the developing station. This blade 11 is formed of an insulating material or an electrically conductive material and in the latter case, it is preferable in stabilizing the potential condition of the developer layer shifted to the developing station S to electrically ground the blade and renders the blade to the same potential as the cylinder 9 so as to avoid formation of an electric field between the two.

Reference numeral 12 designates a multi-pole magnet roll having a plurality of (in the Figure, twelve) equally spaced magnetic poles disposed circumferentially thereof. The magnet roll is disposed within the hollow of the non-magnetic cylinder 9 and forms magnetic fields around the non-magnetic cylinder 9 to thereby cause the insulative, magnetic one-component developer T to be retained on the peripheral surface of the non-magnetic cylinder 9. The multi-pole magnet pole 12 is rotated to convey the developer T along the peripheral surface of the cylinder 9 in the order of the container outlet 10', blade 11, developing station S and container inlet 10'' and to stir the toner particles in the developer layer.

In FIG. 2, the one-component magnetic developer T supplied from the container 10 is conveyed in the direction of arrow $A_2$. Thus, in the embodiment of FIG. 2, the direction of conveyance of the developer layer is counterclockwise and in the developing station S, the direction of movement of the developer is the same as the direction of movement of the photosensitive medium 1' which is rotated clockwisely as viewed in FIG. 2. To enable the developer to be conveyed in the direction of arrow $A_2$, the multi-pole magnet roll 12 is rotatively driven in the direction of arrow $A_3$ opposite to the arrow $A_2$, namely, in the clockwise direction as viewed in FIG. 2. By the rotation of this roller 12, the magnetic line of force resulting from each N and S pole of the roll 12 is rotated around the periphery of the cylinder 9, whereby a force of movement opposite to the direction of rotation of the roll 12, as well as rotational force, is imparted to the magnetic developer particles. Thus, the developer layer is generally moved in the direction of arrow $A_2$ and during that time, in the layer, disturbance movement of the developer particles (toner particles) is created to finely unbind the developer particles so that they may readily adhere to the photosensitive medium while, at the same time, collision and separation between the particles are repeated.

In the embodiment of the present invention shown in FIG. 2, the non-magnetic cylinder 9 is rotatively driven in the direction of arrow $A_4$ which is opposite to the direction of conveyance $A_2$ of the developer, as in the direction of rotation of the magnet roll 12, and accordingly in the clockwise direction as viewed in FIG. 2. Therefore, the cylinder 9 is rotated in the direction which opposes the force of movement of the developer layer on the peripheral surface thereof, and the velocity of rotation of the cylinder 9 is suitably set within such a range that the conveyance force of the developer resulting from the rotation of the magnet roll 12 in the direction of arrow $A_3$ is negated to stop movement of the developer layer in the direction of arrow $A_2$ or the developer layer is not conveyed in the direction opposite to the direction of arrow $A_2$. That is, the cylinder 9 is rotated in the direction opposite to the direction of arrow $A_2$ and at a velocity within such a range that the developer can be moved in the direction of arrow $A_2$. The peripheral velocity of the cylinder 9 is lower than the velocity of movement of the magnetic field on the peripheral surface of the cylinder 9 resulting from the rotation of the magnet roll 12.

Let N be the number of poles on the peripheral surface of the multi-pole magnet roll 12, Rm(r.p.m.) be the number of revolutions of the magnet roll in the direction of arrow $A_3$, D(mm) be the outside diameter of the non-magnetic cylinder 9, and Rs(r.p.m.) be the number of revolutions of the cylinder 9 in the same direction (arrow $A_4$) as the magnet roll 12. Then, the peripheral velocity Vs of the cylinder 9 is represented by $$Vs = \pi DRs \quad (1)$$

On the other hand, the velocity of movement Vst of the developer layer relative to the peripheral surface of the cylinder 9 is represented by $$V_{st} = -AV(Rm - Rs) \quad (2)$$

Accordingly, the velocity of conveyance V of the developer layer relative to the developing station is expressed as $$V = Vs + Vst \quad (3)$$
$$= (\pi D + AN)Rs - ANRm$$

where A is a constant determined by the thickness l(mm) of the developer layer conveyed on the cylinder 9 and the average diameter d(mm) of the developer perticles. Assuming that the particles can be freely rotated by a variation in magnetic field, the maximum value of A is $$Amax = (1-d) + \pi d \quad (4)$$

However, as the developer layer becomes thicker, the free rotational movement of the developer particles usually becomes more limited, so the value of A is usually smaller than the theoretical value indicated in equation (4) above. According to experiment, A is determined within the range of $d < A < 0.8$ in case of a developing device using a usual one-component magnetic developer.

Now, as will be appreciated from equation (3), it is when $V < O$ that the developer layer is conveyed in the direction opposite to the direction of rotation of the multi-pole magnet roll 12, namely, in the direction of arrow $A_2$. Thus, even if the cylinder 9 is rotated in the direction of arrow $A_4$, the number of revolutions Rs of the cylinder 9 which can convey the developer in the direction of arrow $A_2$ is $$0 < Rs < \frac{AN}{\pi D + AN} Rm \quad (5)$$

For example, when the average diameter of the developer particles is of the order of 1μ and the interval between the blade 11 and the cylinder 9 (which determines the thickness of the developer layer) is 0.6 mm, A=0.377. If, then, D=50 mm, Rm=1,000 r.p.m. and N=12, the upper limit of Rs is about 28 r.p.m. Accordingly, Rs is determined to below 28 r.p.m.

In any case, the cylinder 9 carrying the developer thereon is rotated in the direction opposite to the direction of conveyance of the developer and therefore, a force opposite in direction to the direction of conveyance of the developer layer, namely, a force which tends to push back the developer layer, is exerted on the developer layer conveyed on the peripheral surface of the cylinder 9 by the rotation of the magnet roll 12. Thus, the developer may be prevented from being strongly pressed at the minute clearance between the photosensitive medium 1' and the cylinder 9 in the developing station S, and the adherence of the developer to the cylinder 9 or the photosensitive medium 1' and damages which would otherwise be imparted to the cylinder or the photosensitive medium may be eliminated to ensure good development to be accomplished with good reproducibility and in addition, the disturbance movement of the magnetic developer in the developing station S resulting from a variation in magnetic field which in turn results from the rotation of the multipole magnet roll 12 is sufficiently effected so that thin lines or details of the electrostatic image can be developed faithfully and at a proper density and also, the image portion of wider area can be developed uniformly and at a proper density. This effect is particularly useful for a developing device in which the magnet roll 12 is rotated at a very high velocity to provide a developed image as will further be described (in this case, the velocity of conveyance of the developer is also high), or a device in which the photosensitive medium 1' is rotated in the direction of arrow $A_1$, or a developing device in which the peripheral velocity in the direction of arrow $A_1$ is high, or in a case where the apparatus is used under high temperature and high humidity or in a case where a developer of weak magnetism is used. In such devices or under such conditions, if the present invention is not applied, the aforementioned phenomenon of the developer being pressed by and between the photosensitive medium and the cylinder is particularly liable to occur and whenever such phenomenon does occur, no good developed image can be provided as already noted. Particularly, when the peripheral velocity of the photosensitive medium is high, any reduction in the disturbance movement of the toner affects the quality of the developed image more seriously.

Another advantage resulting form the rotation of the developer carrying cylinder 9 in the direction opposite to the direction of conveyance of the developer lies in that since the force pushing back the developer layer is exerted on the developer layer as already mentioned, the developer in the developer pool T' formed in the entrance area of the developing station S as shown in FIG. 2 is prevented from being pressed by and between the photosensitive medium and the cylinder and in addition, the varied magnetic field resulting from the rotation of the magnet roll 12 coacts with the aforementioned push-back force to intensely stir the developer in the pool. Accordingly, any developer particles in any portion of the developer pool are intensely stirred and the purpose of enlarging the developing width by forming such a pool T' is sufficiently achieved, thus enabling the image portion of wider area of the electrostatic image to be developed at a very proper density and also ensuring thin lines or details of the electrostatic image to be developed very faithfully and at a proper density.

An example of the experiment effected by the use of the device as shown in FIG. 2 will now be described. As the developer, use has been made of one-component magnetic developer consisting of coloring particles (having an average particle diameter of 11μ) comprising 49.2% by weight of epoxy resin, 49.3% by weight of magnetite and 1.5% by weight of carbon black. This developer has a volume resistivity of about $10^{16}$ Ωcm in the electric field of $10^4$ V/cm in its static state and is highly useful as the developer for the electrostatic image treating process having the electrostatic image transfer step as shown in FIG. 1.

The non-magnetic cylinder 9 is formed of aluminum and has an outside diameter of 50 mm. The blade 11 is also formed of aluminum and there is an interval of 0.6 mm between the blade 11 and the cylinder 9. The multipole magnet roll 12 has twelve poles. The density of magnetic flux on the peripheral surface of the cylinder 9 is about 700 gausses. The photosensitive medium 1' has an outside diameter of 160 mm and has been rotatively driven at a peripheral velocity of 184 mm/sec. in the direction of arrow $A_1$. The electrostatic image had a surface potential of +600 V in the image portion (the area on which the developer is to be deposited; in case where a positive image copy of an original having black characters on a white ground, the portion of the electrostatic image corresponding to the black characters is the image portion and the portion corresponding to the white ground is the non-image portion) and a surface potential of OV in the non-image portion. The minimum interval between the photosensitive medium 1' and the cylinder 9 is 0.4 mm. In such an experimental device, the magnet roll 12 has been rotated at a velocity of 1000 r.p.m. in the direction of arrow $A_3$ while the non-magnetic cylinder 9 has been rotatively driven at 10 r.p.m. in the same direction as the roll 12 (the direction of arrow $A_4$), with a result that even under the conditions of room temperature 20° C. and humidity 65% or under high-temperature and high-humidity conditions of room temperature 35° C. and humidity 85%, the phenomenon of the developer being pressed by and between the photosensitive medium and the cylinder has not take place after the magnet roll has been rotated 100,000 times, and good developed images have been always provided. That is, the image portion of wider area of the electrostatic image has been developed at a proper and uniform density and the details of the image have been faithfully reproduced at a proper density. The image by the developer having the above-described composition has an image transfer rate of about 70% which ensures obtainment of a practical transfer image. The developer contacts the photosensitive medium over a width of about 5 mm downstream of the minimum interval portion between the photosensitive medium and the cylinder with respect to the direction of conveyance of the developer and over a width of about 10 mm upstream of said minimum interval portion, and the difference between the contact widths of the upstream side and the downstream side, namely, the contact width of the first 5 mm or so of the upstream side, is the width of contact of the developer pool T' with the photosensitive medium 1'.

On the other hand, when the cylinder 9 has been fixed for non-rotation in the device of FIG. 2 while the magnet roll 12 has been rotated at 1000 r.p.m., the aforementioned phenomenon of the developer being pressed by and between the photosensitive medium and the cylinder has taken place to substantially prevent development of the electrostatic image at the stage whereat the magnet roll 12 has been rotated 30,000 to 70,000 times under the conditions of room temperature 20° C. and humidity 65%, and said phenomenon has taken place to prevent development of the electrostatic image at the stage whereat the roll 12 has been rotated 9,000 to 15,000 times under the conditions of room temperature 35° C. and humidity 85%. It is attributable to the extremely aggravated flow characteristic of the developer that said phenomenon is liable to take place under high-temperature and high-humidity conditions.

Figure 3:
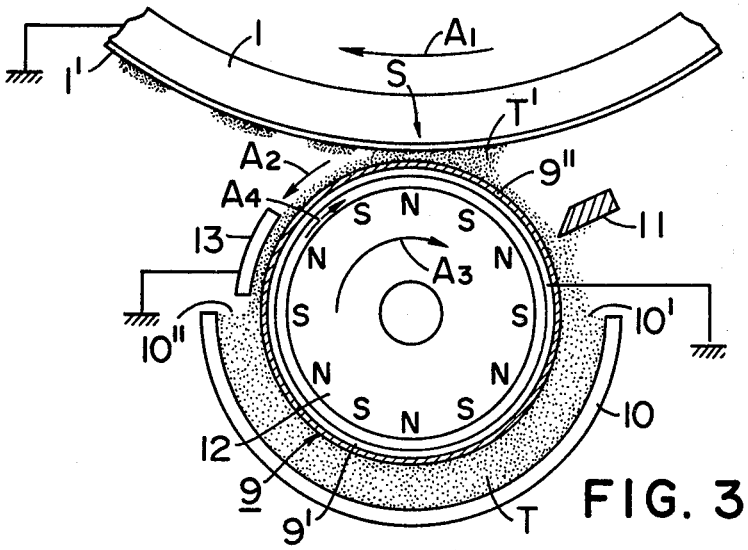
FIG. 3 illustrates another embodiment of the present invention.

FIG. 3 shows another embodiment of the present invention. Members and means common to those in the embodiment of FIG. 2 are given similar reference characters. The common construction of the device will not be described insofar as it is not necessary.

In the embodiment of FIG. 3, the cylinder 9 comprises a circular cylinder 9' of non-magnetic, electrically conductive material such as aluminum or the like having the peripheral surface thereof covered with a coating 9'' of non-magnetic insulating material such as polyethylene or the like. The electrically conductive cylinder 9' is electrically grounded. The developer layer thickness controlling blade 11 is formed of an insulating material such as synthetic resin or the like, but may also be constructed as shown in FIG. 2. Designated by 13 is an electrode plate disposed so as to be in contact with the developer layer downstream of the developing station S and upstream of the container inlet 10'' with respect to the direction of conveyance of the developer. The electrode plate 13 is electrically grounded so as not be create an electric field between the electrode plate and the metallic cylinder 9'. This electrode 13 serves to remove the electric charge from the portion of the developer which has not been consumed for the development of the electrostatic image in the developing station S and to prevent reduction in the developing density. The electrode 13 may be replaced by an A.C. corona discharger or a D.C. corona discharger opposite in polarity to the image portion of the electrostatic image in order to remove the electric charge in said developer. In the embodiment of FIG. 2, the cylinder 9 which is electrically conductive up to the peripheral surface thereof serves also as the electrode for removing the electric charge in said developer, but again in the embodiment of FIG. 2, a charge removing means such as the above-described electrode 13 may be provided.

Again in the embodiment of FIG. 3, experiment has been carried out under the same conditions as the experimental conditions described in connection with FIG. 2, to obtain the same result. That is, even under high-temperature and high-humidity conditions, the phenomenon of the developer being pressed in the developing station S has not taken place and proper, faithful, uniformly developed images have been obtained both for thin-line images and wider-area images.

It is by the following reason that even if the developer is a highly insulative developer like the one having the above-mentioned composition and even if the peripheral surface of the cylinder 9 is electrically conductive or insulative, good developed image is obtained as described above by rapidly rotating the magnet roll 12. In the developing station S, the magnetic field is rapidly varied by the rapid rotation of the multi-pole magnet roll 12. By such variation in the magnetic field, the magnetic developer particles create violent disturbance movement and repeat numerous contacts and separations between one another. On the other hand, although the developer having the above-mentioned composition has particles accumulated and is highly insulative, those particles have scattered in the main area of the insulative surface the exposed surfaces of conductive component such as carbon black in which charge is movable. Therefore, when two developer particles in the developer layer contact each other in such surface conductive area due to the disturbance movement, induced charge opposite in polarity to the image portion of the electrostatic image is stored in the conductive particle component of one developer particle nearer to the photosensitive medium due to the electric field formed in the developing station S by the charge of the image portion of the electrostatic image (the electrically conductive cylinder 9 or 9' acts as the opposed electrode) while induced charge of the same polarity as the image portion of the electrostatic image is stored in the conductive particle component of the other particle far from the photosensitive medium. Next, when these two particles are separated by the same disturbance movement, they become charged to the opposite polarities, whereby the particle having the charge of the opposite polarity to the image portion of the electrostatic image adheres to the photosensitive medium to develop the electrostatic image. Such a state is shown in FIG. 4.

Figure 4:
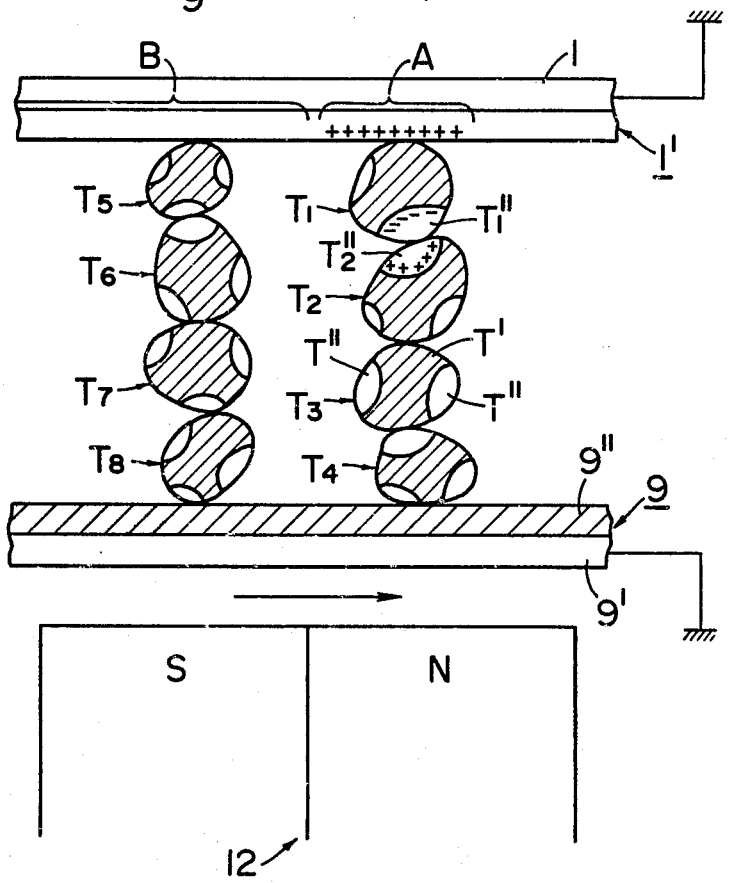
FIG. 4 illustrates the principle of development utilized in the embodiments.

FIG. 4 is an enlarged view of the developing station S in the device of FIG. 3 and the following description also applies to the device of FIG. 2 if the insulating layer 9″ of the cylinder 9 is removed.

Toners $T_1$–$T_8$ carried by the non-magnetic cylinder 9 form a developer layer on the cylinder 9 and the surface layer portion thereof contacts the surface of the photosensitive medium 1′. The toners $T_1$–$T_8$ comprise insulative substrates (formed of synthetic resin or the like) T′ having an insulative surface and conductors (which may be semiconductors) T″ such as carbon black or the like exposed on the surfaces of the substrates and in which charges are movable. In order that the whole developer may be insulative, the average interval between adjacent ones of electrically isolated conductive areas of the toner surface should preferably be greater than the average of the longest diameters of the conductive areas.

In FIG. 4, an electrostatic image is formed on the photosensitive medium 1′ and it is assumed that the potential polarity of the image portion A thereof (the area to which the developer is to adhere to color and make visible the same) is positive, and that the potential of the non-image portion B (the area to which the developer is not to adhere) is zero. Thus, in FIG. 4, between the photosensitive medium 1′ and the developer carrier 9, an electrostatic field is formed in the area of the image portion A of the electrostatic image by the charge in this image portion A. Within the toner layer in this field, for example, the toners $T_1$ and $T_2$ have their conductors $T''_1$ and $T''_2$ contacting each other. At this time, the two conductors $T''_1$ and $T''_2$ are equivalent to one conductor and therefore, negative induced charge is stored in the conductor $T''_1$ of the toner $T_1$ nearer to the image portion A by the electrostatic induction due to the action of the potential of the image portion A, while positive induced charge is stored in the conductor $T''_2$ of the toner $T_2$ far from the image portion A. In other words, the toner $T_1$ becomes charged condition of the opposite polarity to the image portion A which is attracted by the image portion A and the toner $T_2$ becomes charged condition of the same polarity as the image portion A which is repulsed by the image portion A. Thus, if the toners $T_1$ and $T_2$ are separated from each other by some force, that is, if their conductors $T''_1$ and $T''_2$ are separated from each other, the toner $T_1$ generally becomes negatively charged and shifts toward the image portion A and is adsorbed thereby, while the other toner $T_2$ generally becomes positively charged and moves away from the image portion A and tends to shift toward the developer carrier 9 due to the action of the electrostatic field. Now, the rate of area occupied by the conductive region of the developer particle surface or the region in which charger is movable is small in case of an insulative developer and therefore, in order to increase the number of particles charged to the polarity for developing an electrostatic image by the electrostatic induction phenomenon of the above-described conductor, in other words, in order that as many developer particles as to enable obtainment of a developed image of practical concentration (the reflection concentration is approximately above 1) may be charged by the above-described mechanism, it is necessary to increase the number of contacts between the particles and accordingly, it is necessary to violently stir the developer. For this purpose, the multi-pole magnet roll 12 may be rapidly rotated. In that case, if the cylinder 9 is rotated in the same direction as the magnet roll 12, the degree of disturbance of the developer in the developing station can be increased conjointly with the variation in magnetic field resulting from the rotation of the magnet roll to thereby obtain a better developed image.

Now, if the toner is charged in the above-described manner, the quantity of toner necessary for the development is sufficiently supplied in the neighborhood of the surface of the photosensitive medium 1′. The time required for these toners to reach the surface of the photosensitive medium is very short. Consequently, even thin lines are uniformly and faithfully developed with a proper concentration and black solids, thick lines, bands, etc. are also developed uniformly and faithfully with a proper concentration but without sweep and tear. The toner charged to the same polarity as the image portion which is created in the neighborhood of the photosensitive medium moves away from the photosensitive medium 1′ and toward the carrier 9 but part of such toner contacts, on its way, the toner which moves toward the photosensitive medium by being imparted induced charge of the opposite polarity to the image portion by the aforementioned image portion potential in the neighborhood of the carrier 9, thus effecting discharge. The remainder of the charged toner discharges to the cylinder 9 in FIG. 2 and to the electrode 13 in FIG. 3, so that the toner layer as a whole restores its non-charged condition. By this, a high concentration and contrast of the developed image is maintained and aggregation of charged toner is prevented.

On the other hand, in the region corresponding to the non-image portion B of the electrostatic image, no electrostatic field is formed between the photosensitive medium 1′ and the developer carrier 9 and therefore, in the toner layer lying within this region, no electrostatic induction phenomenon occurs even if the surface conductive regions contact each other like toners $T_5$ and $T_6$ and thus, the toner charged to the positive or to the negative does not occur in this toner layer.

The movement of charge in the electrostatic induction phenomenon resulting from the aforementioned electrostatic image potential between the contacting toner particles in the surface conductive region also occurs between the toner particles in the other portion than the portion near the electrostatic image, namely, the toner particles near the carrier 9, if there is a sufficient potential difference between the electrostatic image carrier 1′ and the developer carrier 9. However, the toner particles charged to the opposite polarity to the image portion in the neighborhood of the carrier 9 hardly contribute to the development of details of the electrostatic image. This is because a certain degree of time is required for those of the violently disturbed many toner particles which store therein charge to approach the image portion of the electrostatic image from a long distance. Therefore, when thin lines of the electrostatic image (these have a width of 100μ when the resolving power of 5 lines/mm is required and a width of about 50μ when the resolving power of 10 lines/mm is required) come to the developing station, and when the toner particles having stored therein the charge of the opposite polarity to the thin line latent image in the neightborhood of the developer carrier are moved to the surface of the developer layer by such thin line latent image potential, it seems that the thin line latent image of the electrostatic image has already moved far away from the position which has been reached by these toner particles.

In order to obtain a transfer image of practicable concentration, the developer should preferably have a volume resistivity of $10^{14}$ Ωcm or higher in its static state in an electric field of $10^4$ V/cm, and it has been empirically confirmed that in order to obtain a developed image of practicable concentration by the principle described in connection with FIG. 4, the developer may generally be stirred at such a speed that the volume resistivity thereof in the developing station is apparently decreased below $10^{11}$ Ωcm. The measurement of the volume resistivity in the static state has been carried out under indoor conditions by the use of a measuring device comprising aluminum electrodes of a measuring portion area 100 mm×100 mm provided at intervals of 1.0 mm, guard electrodes provided at intervals of about 5 mm from the periphery of the electrodes and Teflon members insulating the electrodes, with the sample filling between the electrodes. (The developer having the above-described composition exhibits a volume resistivity of about $10^{7}$Ωcm in the static state in an electric field of $10^4$ V/cm.)

On the other hand, the measurement of the volume resistivity of the developer in its dynamic state has been carried out by using, under indoor conditions, the device of FIGS. 2 and 3 but in which the photosensitive medium 1' is replaced by aluminum film lined with a polyester insulating film. A D.C. voltage of +500 V has been applied to the aluminum film. Other numerical data have been the same as those already mentioned. With the terminal of a measuring meter attached to the aluminum film and the cylinder 9 (FIG. 2) or the discharging electrode 13 (FIG. 3), the current apparently flowing through the developer layer has been measured and the volume resistivity in the dynamic state has been calculated. When the developer having the above-described composition is used, it has been found that a practicably developed image can be obtained if the magnet roll 12 in the aforementioned device is rotated at a velocity of about 650 r.p.m. (at the same time, the cylinder 9 has been rotated at 6.5 r.p.m.) or higher. (At this time, the apparent volume resistivity of the developer in the developing station is about $10^{11}$ Ωcm.) For the above-described two measurements of the volume resistivity, use has been made of the YHP4329A high resistance meter produced by YHP and of a method of calculating the volume resistivity from a current value by the use of Kikusui Model 104 standard voltage source and μA meter.

Of course, in the electrophotographic process having no image transfer step, the developer used may be the high resistance developer as described, but a developer of low resistivity or a so-called conductive developer may be utilized and in this case, the magnet roll 12 may be rotated at a lower velocity than that in the described embodiment. Even in that case, if the present invention is utilized, the above-mentioned phenomenon of the developer being pressed in the developing station may be prevented to obtain a very good developed image, as will readily be appreciated. However, too low a velocity for the magnet roll 12 would cause appreciable periodic concentration irregularity to the developed image on the photosensitive medium under the influence of the boundary portion between the magnetic poles in the circumference of the magnet roll passing through the developing station. The interval between these concentration irregularities is 60 Vp/Rm N(mm), where Vp is the peripheral velocity (mm/sec.) of the photosensitive medium, and Rm and N are as already described. Generally, if the said interval is 3 mm or less, the adjacent irregularities offset each other and become negligible. It is therefore desirable that the magnet roll 12 be rotated at a velocity of 20 Vp/N(r.p.m.) or higher.

In the embodiment of FIG. 2, the photosensitive medium 1' is moved in the developing station in the same direction as the direction of conveyance of the magnetic developer. By this, the occurrence of the so-called sweep phenomenon in the developed image may be more effectively prevented, but the photosensitive medium 1' may also be moved in the developing station in the opposite direction to the direction of conveyance of the magnetic developer. By this, a pool of developer may be more easily formed on the inlet side of the developing station and in this case, according to the present invention, the developer particles in any portion of the developer pool are actively disturbed so that the benefit of the increased developing width can be sufficiently brought about to the quality of the developed image.

Figure 5:
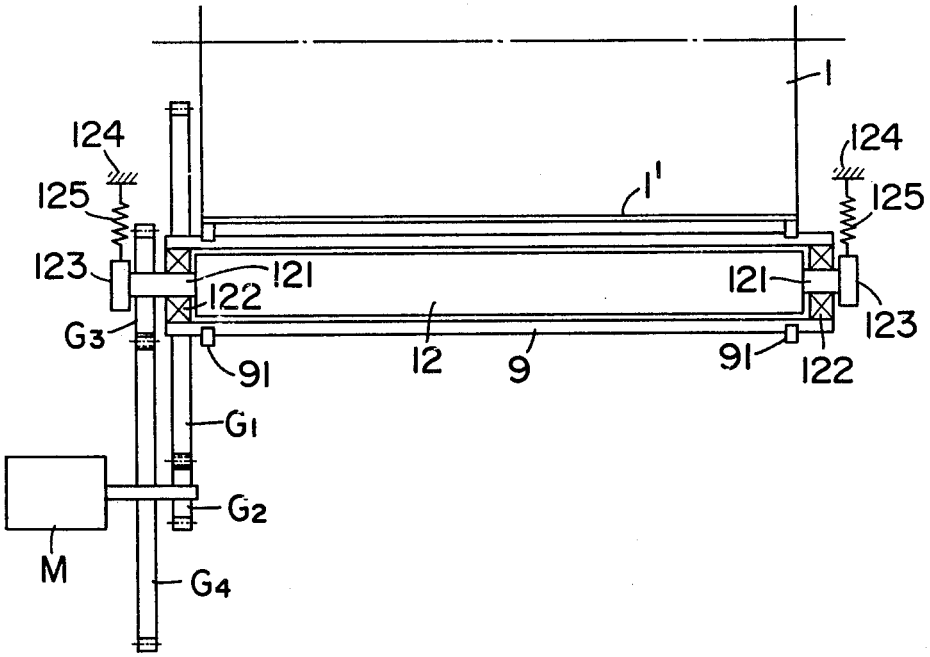
FIG. 5 illustrates the mechanism for rotatively driving a cylinder and a magnet roll.

Here, description will be made of an example of the driving mechanism for the non-magnetic cylinder 9 and multi-pole magnet roll 12 in the above-described embodiment, by reference to FIG. 5. The non-magnetic cylinder 9 has rings 91 fitted for rotation relative thereto in circumferential grooves provided at the opposite ends thereof, the rings 91 functioning as spacers. These rings 91 rotatably bear against the non-image forming regions of the peripheral surface of the photosensitive drum 1 at the axially opposite ends thereof so as to form and maintain a predetermined narrow interval between the cylinder 9 and the photosensitive medium 1' in the axial direction thereof. The magnet roll 12 is rotatably supported with respect to the cylinder 9 by a shaft 121 projected from the opposite ends of the magnet roll being fitted to bearings 122 which in turn are fitted to the axially opposite ends of the inner peripheral surface of the cylinder 9. Further, bearings 123 are rotatably fitted to the opposite ends of the shaft 121. Tension springs 125 are interposed between these bearings 123 and the immovable member 124 of the apparatus body and resiliently bias the cylinder 9 with the magnet roll 12 toward the photosensitive drum 1 so as to maintain a constant interval between the cylinder and the photosensitive medium even if the drum is eccentric due to the rings 91 being normally resiliently urged against the drum. The cylinder 9 and the magnet roll 12 take the rotative drive from a motor M through a gear train. The motor M may be common to the motor for rotatively driving the drum 1. Now, the cylinder 9 has a gear $G_1$ fixed to one end thereof. The gear $G_1$ is in mesh-engagement with a gear $G_2$ fixed to the shaft of the motor M. The magnet roll 12 has a gear $G_3$ fixed to the shaft at one end thereof. The gear $G_3$ is in mesh-engaging with a gear $G_4$ fixed to the shaft of the motor M coaxially with the gear $G_2$. With such a construction, if the motor M is rotated, the magnet roll 12 and the cylinder 9 are rotated in the same direction, and the direction of rotation of the motor M is determined such that the direction of rotation of the magnet roll and cylinder is opposite to the direction of conveyance of the developer. Assume that the numbers of teeth of the gears $G_1$, $G_2$, $G_3$ and $G_4$ are $g_1$, $g_2$, $g_3$ and $g_4$, respectively and that the ratio between the number of revolutions of the roll 12 and that of the cylinder 9 is Rm/Rs (in the above-described example of experiment, 100) The numbers of teeth of the gears are set such that $Rm/Rs = g_1 \cdot g_4 / g_2 \cdot g_3$. Further, assume that the number of revolutions of the shaft of the motor M is R (r.p.m.). Then, the numbers of teeth of the gears are set such that $Rs/R=g_2/g_1$ and $Rm/R=g_4/g_3$.

In the above-described embodiment, the non-magnetic developer carrier means has been shown in the form of a cylinder 9, whereas it may be in the form of a belt stretched between a plurality of pulleys and moved round in the opposite direction to the direction of conveyance of the developer. Also, while the movable magnet member has been shown as a multi-pole magnet circular cylinder 12, it may be in the form of a polygonal pillar or a belt stretched between a plurality of pulleys and moved round in the opposite direction to the direction of conveyance of the developer and at a velocity whereat the developer is conveyed against the movement of the developer carrier means.

The present invention is not restricted to electrophotography, but is applicable to any image processing device in which an electrostatic image is formed on its carrier, whereafter it is developed with the aid of one-component magnetic developer.

Also, the one-component developer usable with the present invention may be a magnetic developer, and the high or low of the volume resistivity thereof and the strength of the magnetism thereof do not matter nor does it matter whether or not a region in which charge is movable is present on the surface of the developer particles.

In the embodiments of FIGS. 2 and 3, the doctor blade 11 is used to control the thickness of the conveyed developer, but the end of the side wall of the developer outlet portion 10' of the container 10 may be disposed in proximity to the peripheral surface of the cylinder 9, whereby such end of the side wall may be used also as the doctor means. In this case, to have a developer pool formed on the inlet side of the developing station, the internal between the above-described side wall end of the container outlet side and the peripheral surface of the cylinder should desirably be equal to or slightly greater than the minimum internal between the cylinder and the electrostatic image carrier.

What we claim is:

1. A development process comprising:

providing a one-component magnetic developer consisting of particles which have an insulating main component on the surface of which there are scattered areas in which electric charges are movable, said magnetic developer, as a whole, being electrically insulative under mechanically static conditions;

supplying the developer to a developer carrying member;

forming a magnetic field around the developer carrying member by magnetic field forming means; and simultaneously moving the magnetic field and the developer carrying member in the same direction with the magnetic field moving at a speed high enough with respect to the speed of the developer carrying member to convey the developer on the developer carrying member in the opposite direction to the movement direction of both the magnetic field and developer carrying member and toward a developing station where the developer contacts an image bearing member, said movement stirring the developer and causing some of the developer to be attracted to the potential on the image bearing member in the developing station.

2. A development process comprising:

disposing a developer carrying member adjacent to but spaced from an image bearing member to define a minute clearance therebetween at a developing station;

moving the image bearing member in a predetermined direction;

supply one-component magnetic developer to the developer carrying member;

forming a magnetic field around the developer carrying member by magnetic field forming means;

simultaneously moving the magnetic field and the developer carrying member in the same direction with the magnetic field moving at a speed high enough with respect to the speed of the developer carrying member to convey the developer on the developer carrying member in the opposite direction to the movement direction of both the magnetic field and developer carrying member and toward a developing station where the developer contacts the image bearing member while moving in the same direction as the image bearing member, wherein the movement of the developer carrying member facilitates stirring of the developer and opposes the pressing of the developer against the image bearing member at the minute clearance.

3. The development process of claim 1 or 2, further comprising providing a developer layer thickness control means upstream of the developing station with respect to the direction of conveyance of the developer and opposed to the surface of the developer carrying member with a clearance therebetween for controlling the layer thickness of the developer conveyed to the developing station so that a pool of the developer is formed at an inlet region of the developing station.

4. The development process of claim 3, wherein the clearance provided between the thickness control means and the developer carrying member is greater than the minimum clearance between the image bearing member and the developer carrying member in the developing station.

5. The development process of claim 1, 3, or 4, wherein the image bearing member is moved in the developing station in the same direction as the direction of conveyance of the developer.

6. The development process of claim 1 or 2, wherein the developer, when in its static state, generally has a volume resistivity of $10^{14}$ cm or higher in an electric field of $10^4$ V/cm, and wherein the magnetic field is moved at such a velocity that the volume resistivity of the developer is decreased below $10^{11}$ cm in the developing station.

7. The development process of claim 1 or 2, wherein the surface of the developer carrying member is insulative.

8. The development process of claim 7, further comprising providing means for removing the charge in the developer disposed downstream of the developing station with respect to the direction of conveyance of the developer.

9. The development process of claim 1 or 2, wherein the surface of the developer carrying member is electrically conductive.

10. The development process of claim 1 or 2, wherein the developer carrying member is a non-magnetic cylindrical member and the magnetic field is formed by a magnet roll disposed in the hollow of the cylindrical member, the magnet roll having a plurality of magnetic poles.

11. The development process of claim 10, further comprising providing developer layer thickness control means upstream of the developing station with respect to the direction of conveyance of the developer and opposed to the surface of the cylindrical member with a clearance therebetween for controlling the layer thickness of the developer conveyed to the developing station so that a pool of the developer is formed at an inlet region of the developing station.

12. The development process of claim 11, wherein the clearance provided between the thickness control means and the cylindrical member is greater than the minimum clearance between the image bearing member and the cylindrical member in the developing station.

13. The development process of claim 10, wherein the image bearing member is moved in the developing station in the same direction as the direction of conveyance of the developer.

14. The development process of claim 10, wherein the developer, when in its static state, generally has a volume resistivity of $10^{14}$ cm or higher in an electric field of $10^4$ cm, and wherein the magnetic roll is rotated at such a velocity that the volume resistivity of the developer is apparently decreased below $10^{11}$ cm in the developing station.

15. The development process of claim 10, wherein the surface of the cylindrical member is insulative.

16. The development process of claim 15, further comprising removing the charge in the developer disposed downstream of the developing station with respect to the direction of conveyance of the developer.

17. The development process of claim 10, wherein the surface of the cylindrical member is electrically conductive.

18. The developing process of claim 10, wherein the cylindrical member and magnetic roll are rotated so as to satisfy the following relation:

$$0 < R_s < \frac{AN}{\pi D + AN} R_m$$

wherein:

A is a constant determined by the thickness of the developer layer and the average diameter of the developer particles;

N is the number of magnetic poles;

D is the outside diameter of the cylindrical member;

$R_s$ is the number of revolutions of the cylindrical member; and $R_m$ is the number of revolutions of the magnetic roll.

* * * * *

UNITED STATES PATENT AND TRADEMARK OFFICE

CERTIFICATE OF CORRECTION

PATENT NO. : 4,430,411

DATED : February 7, 1984

INVENTOR(S) : YASUYUKI TAMURA, ET AL.

It is certified that error appears in the above-identified patent and that said Letters Patent is hereby corrected as shown below:

Column 1, line 46, "one" should read --developer--;
line 55, "mangetic" should read --magnetic--.

Column 4, line 11, after "of" insert --a--;
line 23, "to" (third occurrence) should read --the--;
line 59, "usble" should read --usable--; "densiy" should read --density--;
line 61, "with" should read --without--.

Column 5, line 36, "developed" should read --developer--.

Column 6, line 32, "in" should read --is--.

Column 7, line 12, "perticles" should read --particles--;
line 38, "1μ" should read --11μ--.

Column 8, line 21, "form" should read --from--.

Column 9, line 16, "take" should read --taken--.

Column 10, line 5, "be" should read --to--.

Column 12, line 63, "neightborhood" should read --neighborhood--.

UNITED STATES PATENT AND TRADEMARK OFFICE

CERTIFICATE OF CORRECTION

PATENT NO. : 4,430,411

DATED : February 7, 1984

INVENTOR(S) : YASUYUKI TAMURA, ET AL.

It is certified that error appears in the above-identified patent and that said Letters Patent is hereby corrected as shown below:

Column 13, line 20, "10 ≠Ωcm" should read --$10^{16}$ Ωcm--.

Column 14, line 55, "engaging" should read --engagement--.

Signed and Sealed this

Twelfth Day of June 1984

[SEAL]

*Attest:*

GERALD J. MOSSINGHOFF

*Attesting Officer*

*Commissioner of Patents and Trademarks*